US007130708B2

(12) United States Patent
Wang et al.

(10) Patent No.: US 7,130,708 B2
(45) Date of Patent: Oct. 31, 2006

(54) DRAW-IN MAP FOR STAMPING DIE TRYOUT

(75) Inventors: Chuan-Tao Wang, Troy, MI (US); Norman Goan, Troy, MI (US); Jimmy J. Zhang, Troy, MI (US)

(73) Assignee: General Motors Corporation, Detroit, MI (US)

( * ) Notice: Subject to any disclaimer, the term of this patent is extended or adjusted under 35 U.S.C. 154(b) by 758 days.

(21) Appl. No.: 10/404,728

(22) Filed: Apr. 1, 2003

(65) Prior Publication Data

US 2004/0199270 A1 Oct. 7, 2004

(51) Int. Cl.
*G06F 19/00* (2006.01)

(52) U.S. Cl. ..... 700/111; 700/30; 700/109; 700/117

(58) Field of Classification Search ..... 700/30, 700/95, 97, 98, 108, 109, 110, 111, 117, 118, 700/174, 176, 182, 193; 72/17.3, 362, 379.2
See application file for complete search history.

(56) References Cited

U.S. PATENT DOCUMENTS 5,974,847 A * 11/1999 Saunders et al. ..... 72/57
6,769,280 B1 * 8/2004 Cao et al. ..... 72/17.3
2002/0186007 A1 12/2002 Cao et al.
2003/0167097 A1 * 9/2003 Hillmann et al. ..... 700/98

* cited by examiner

*Primary Examiner*—Leo Picard
*Assistant Examiner*—Charles Kasenge
(74) *Attorney, Agent, or Firm*—Laura C. Hargitt

(57) ABSTRACT

Sheet metal forming is a manufacturing process in which flat sheet metal is drawn into a die cavity to form a product shape. Draw-in amount is the single most important stamping index that controls all forming characteristics (strains and stresses), formability failures (splits, wrinkles) and surface quality (distortions) on a panel. Adaptation of a new die set for repetitively stamping sheet metal parts to a part design specification is simplified by using a math-based simulation of the stamping operation under specified engineering stamping conditions for the specified part. The stamping simulations are used to create an engineered draw-in map comparing selected locations on the peripheral edge of the stamped part with corresponding locations on the peripheral edge of its original sheet metal blank. The resulting map of sheet metal draw-in dimensions reflect suitable displacements of the metal sheet between the binder ring and binder surface of the female die member at all such locations as the punch member of the die set executes its stamping operation. The engineered draw-in dimensions for a simulated part identify specific locations for adjustment of the binder ring/binder surface system in adapting the die set for production of parts.

12 Claims, 3 Drawing Sheets

DRAW-IN MAP FOR STAMPING DIE TRYOUT

TECHNICAL FIELD

This invention pertains to sheet metal formability and die making, and to methods for tryout of dies for sheet metal forming. More specifically, this invention relates to the use of a map of sheet metal draw-in or displacement distances around the periphery of a stamped sheet metal part in math-guided tryout of a three or four component die set comprising a punch, binder ring(s) and female die designed for making the part.

BACKGROUND OF THE INVENTION

A conventional three-component die set for stamping sheet metal parts consists of a punch, a binder ring and a female die. Such die sets are used to make many strong and light weight articles of manufacture. These articles include, for example, automotive body panels and other structure parts; aircraft and appliance sheet components; and beverage cans. Families of formable ferrous and aluminum sheet metal alloys have been developed for these manufacturing processes.

In a typical sheet metal forming operation, a flat blank of the metal is held at its periphery over the shaped cavity surface of a female die and the sheet is pulled into the cavity and against the shaped surface using a punch with a forming surface complementary to that of the female die. The sheet is drawn and stretched between the tools and assumes a desired shape. In making stamped parts such as automotive body panels, often characterized by deep pockets and small radii bends, the panel may be formed in stages using two or more sets of stamping dies each operated in a suitable hydraulic press.

In sheet metal stamping operations the blank is clamped at its periphery against the marginal surface of the female die cavity with a blank holder called the binder ring. The interaction between the binder ring, the interposed sheet and the binder portion at the margin of the female die is critical to making a part that is formed free of wrinkles or tears. The binder ring has a bead that presses adjacent sheet metal into a complementary depression, a trough, in the binder portion of the female die to create proper restraining forces that prevent the sheet metal from being drawn to the die cavity too freely (and cause wrinkles on the sheet metal) or too restrictively (thus causing panel splits). Thus, a peripheral ring of the blank material is crimped and grasped by the binder ring system. When operation of the stamping press brings the punch into contact with the blank, the metal sheet is drawn and/or stretched into the forming cavity. The binder bead/trough interactions at each point around the entire periphery of the blank control the local amount of sheet metal drawn into the forming die. The draw-in of too little metal over the binder ring system can lead to tears or cracks in the stamped part, and too much drawn metal can lead to wrinkles and surface distortions. The draw-in amount is controlled by the die design and die construction, the forming process parameters (binder force, lubrication, die set-up), and the sheet metal properties.

In a traditional die development and making process, a die is designed based on previous experience, and the die is validated through a series of physical tryouts. These tryouts are time consuming and costly and cannot guarantee the success of the die developments. For a typical automotive body panel, say a fender, the tryout alone could last twelve months and cost more than one million U.S. dollars. Today in math-based die development practice, the design of a die can be evaluated and reshaped through electronic tryout via advanced stamping simulation technology that consists of stamping CAE (computer aided engineering) programs, sheet metal forming simulation software (e.g., Pamstamp™ and Dyna3D™) and high performance computers.

After the die sets for a vehicle body panel, for example, are designed or developed successfully in the digital world, the dies are constructed and tried out in a tooling shop. However, there are differences between the engineering of a die set and its everyday use in a manufacturing operation. And there are differences in results obtained between digital simulation of die operation and physical parts produced in a stamping plant. One aspect of the problem is that die makers are not so familiar with math-based die engineering principles that they can make good use of the math-based work in tuning actual dies for everyday stamping operations and ordinary sheet metal material. Therefore, physical tryout periods for each set of manufacturing dies can still take weeks or months because there has been no robust procedure by which manufacturing people can detect and correct differences between an actual die set and the math-based simulation from which it was built.

It is an object of this invention to provide a process for conforming actual sheet metal stamping experience using a specific die set with state-of-the-art math-based simulation of the die set and stamping operation. It is a more specific object of this invention to provide a process for using the exact amount of sheet metal drawn in over the binder ring at selected locations around the periphery of the blank as a practical and effective basis to conform the operation of the physical die set to the simulated performance of the virtual die set.

SUMMARY OF THE INVENTION

This invention makes use of the capabilities of current mathematically based, computer executed sheet metal forming technology to produce a data set that can be used by stamping die tryout workers to rapidly produce defect free stamped parts using the stamping die set. This invention is a process that is based on the premise that the amount of sheet metal blank that is drawn into the die cavity is a critical manufacturing index that suitably reflects actual strains, stresses and thinning experienced by the stamped metal. It is perceived that the amount of draw-in can be used to anticipate stamping failures and that controlling the amount of draw-in at selected locations around the periphery of the blank is a simplest and robust way for die makers on the shop floors to tune the die set to make good stampings with a maximum efficiency and minimum efforts and costs.

In accordance with the practice of the invention, the math-based process is used to simulate the stamping of the part using the stamping die set made in accordance with the die design specified by the computer process. The math-based process is used to predict the sheet metal draw-in amount at sheet metal strain and stress levels throughout the stamping stroke of the punch that produce a defect free part. The mathematical simulation takes into account specified engineering die tryout conditions. These conditions include the material specification of the blank and its mechanical properties such as yield strength, ultimate tensile strength and coefficient of friction. The engineered die tryout conditions also include the thickness and shape (geometry) of the blank, the amount of binder travel, binder force (tonnage), forming tonnage, male bead and female bead (trough) configuration, lubrication, and the like. An engineered draw-in map is prepared comparing the periphery of the original blank with the shrunken periphery of the part as formed in the computer simulation. The draw-in map shows the linear dimensions in, e.g., millimeters, at locations around the plan view of the part of the draw-in of the sheet from the flat blank to the formed panel. In addition, like draw-in maps can be prepared at intermediate part forming stages based, e.g., on the apparent travel of the punch from initial contact with the blank to the completion of the die set forming stroke.

Die tryout workers can use the engineered draw-in map as a basis for correcting actual draw-in of the blank on the real die set. Where the sheet metal draw-in distance on the trial part is larger or smaller than the map dimensions suitable compensation adjustments are made to the bead shapes to reduce or increase sheet metal flow. Invariably, as the actual draw-in values around the periphery of formed parts are brought into conformity with the simulated stamping draw-in values, good parts are produced.

The advantage of this invention is that die tryout workers can focus on draw-in of the sheet metal as the part is formed, one of the occurrences that they regularly observe in the making of each stamping. Now, with the use of the engineered draw-in map, die tryout workers can more efficiently approach the die tryout process by conforming actual sheet metal draw-in dimensions with the math based simulation draw-in map and, where necessary, making adjustments to the beads at specific locations identified from the draw-in map.

Other objects and advantages of the invention will become apparent from a detailed description of a preferred embodiment of the draw-in map process.

BRIEF DESCRIPTION OF THE DRAWINGS

FIG. 5A schematically shows the position of the die components as the binder ring has wrapped the blank against the female die surface, and the punch is first touching the surface of the secured blank. In this example, the punch is 137 millimeters from the completion of the die set forming stroke.

FIG. 5B shows the position of the die components and sheet metal when the punch has advanced to a position 73 millimeters from the completion of the die set forming stroke.

FIG. 5C shows the position of the die components and sheet metal when the punch is 19 mm from the completion of the die set forming stroke.

FIG. 5D shows the completion of the forming stroke of the die set.

DESCRIPTION OF THE PREFERRED EMBODIMENT

The practice of the invention is illustrated in connection with the stamping of an automotive vehicle fender outer panel. The fender panel may be stamped using a suitable low carbon steel metal blank or aluminum alloy blank, or the like. A shape for the fender is conceived by automotive designers. The design is transcribed into mathematically based dimensional and spatially locating data for use in computer assisted engineering design of a die set for the stamping of the fender panel. Commercially available computer based programs such as those identified above are used to then design a female die surface and a male punch surface and a binder ring shape suitable for controlling the stamping of the selected sheet metal material. Data concerning the thickness of the sheet metal, its physical properties and its deformation forming characteristics are used in the computer program in the design of the die set. Some panel shapes may require more than one stamping operation and, thus, more than one set of stamping dies to make the part.

Figure 1:
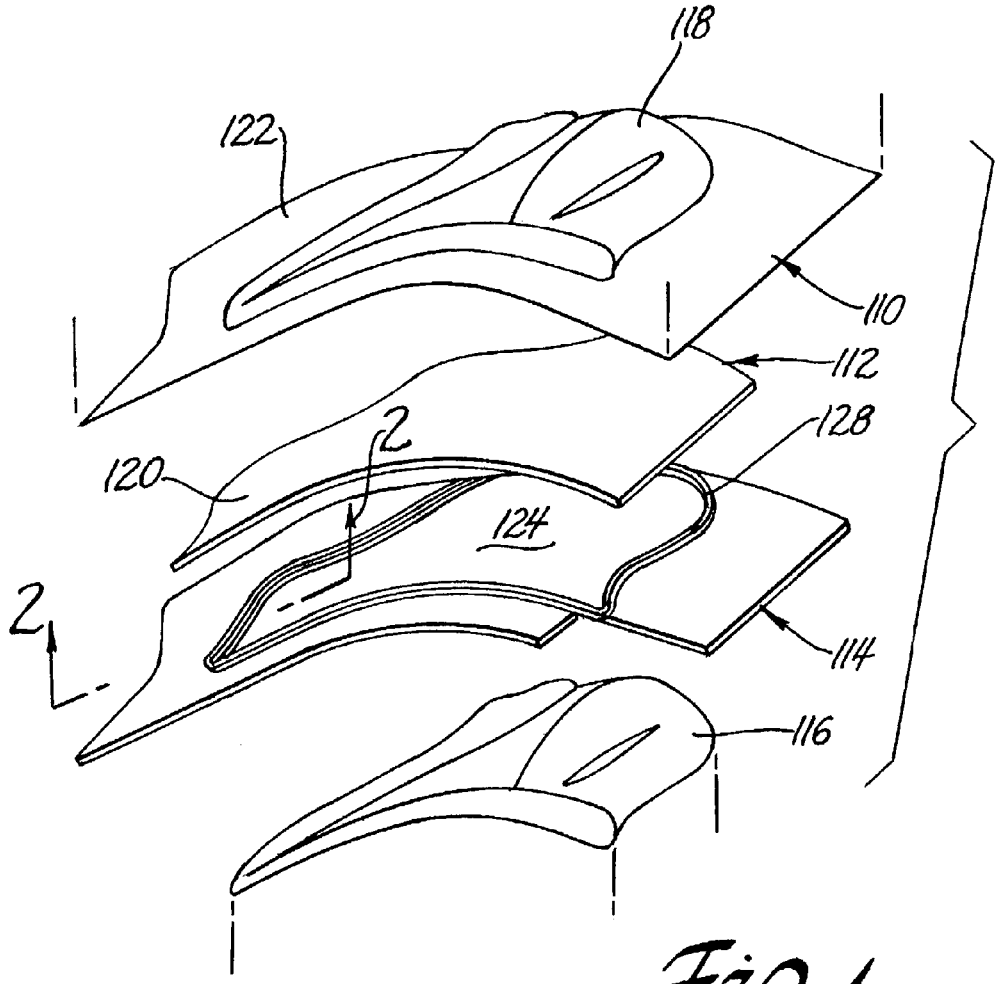
FIG. 1 is an exploded view of the forming surfaces of a three-piece die for forming a vehicle fender panel. The figure comprises, from top to bottom, the forming and peripheral surface of the female die, the sheet metal blank, the binder ring surface, and the punch forming surface.

The die components of a set are then made by known practices and as soon as they have been finish machined or otherwise shaped to the specification of the math based program, the components are ready for try-out with an actual blank of the specified sheet metal material. FIG. 1 illustrates, in exploded view, the arrangement of the movable female forming die surface 110 (sometimes called the upper die surface in this specification), a sheet metal blank 112, binder ring 114, and a stationary male punch surface 116. The full die members are not shown to simplify the illustration.

The female die member is secured in the upper platen of a suitable stamping press. The press is of known design and is also not shown to simplify the illustration. In this example, the female die surface 110 is movable. Female die surface 110 has a shaped cavity portion 118, the surface of which is designed to shape the top surface 120 of blank 112 as the outer surface of a fender panel in a stamping operation. Female die surface 110 also has a peripheral surface 122 completely surrounding cavity portion 118. During a stamping action of the press and die components, the peripheral portions of blank 112 are clamped against peripheral surface 122 of the upper die 110 by binder ring 114.

Binder ring 114 is also secured in the press in a manner so that it can be separately moved to clamp an inserted blank 112 against peripheral surface 122 of the upper die when the upper die 110 is moving downwardly with the press rams. Binder ring 114 is shaped to define an opening 124 through which the punch die member with its punch surface 116 can enter to push against the lower surface 126 (see FIG. 2) of blank 112 as it is moved downwardly by upper die surface 110. Binder ring 114 also has a bead 128 which is illustrated in FIG. 1 as a single continuous linear raised surface like a ring around the perimeter of opening 124. Bead 128 will typically have different cross-sectional shapes in different regions around its ring configuration, and the bead ring may be formed in discrete linear segments.

The stationary punch die member, with its punch surface 116, is secured to the lower platen of the press.

As may be apparent from the brief description of the die components, a fender panel stamping cycle is commenced with the die component members and surfaces in their open position as shown in FIG. 1. The lower platen of the press supports punch with punch surface 116 in the open position of the die set. Binder ring 114 has been lowered to permit the insertion and precise location of blank 112 between the upper die surface 110 with peripheral surface 122 and binder ring bead 128. In a first closing step of the press, the upper die surface 110 is moved down to press the blank 112 against binder ring 114. Binder ring 114 engages the bottom surface 126 of blank 112 to clamp the perimeter of the blank 112 against the peripheral margin surface 122 of the upper die surface 110. Bead 128 on the binder ring 114 presses the overlying blank material against upper die surface 122 and crimps peripheral blank material into trough 130 (see Figure 2) formed in peripheral surface 122. Trough 130 is shown only in a cross-section in FIG. 2. But trough 130 is formed in a ring-like linear path in surface 122 completely around the cavity surface 118 so that it overlies bead 128. The opposing portions of the bead 128 and trough 130 cooperate in each portion of their respective rings to control the draw-in of sheet metal during stamping. As will be described further, the specific shapes and dimensions of bead 128 and trough 130 control the draw-in of the blank material when the punch surface 116 forces the blank 112 against cavity surface 118.

When upper die surface 110 is moved to press blank 112 and binder ring 114 downwardly, the stationary punch with punch forming surface 116 engages the lower side 126 of blank 112 and continually pushes it into the cavity of the upper die into conformance with female die surface 118 to thus form the fender panel sheet. In the closing operation of the press, punch surface 116 passes through opening 124 in binder ring 114 to draw a portion of the blank into the upper die cavity 118. Of course, metal at the edge of the blank 112 is pulled over the bead 128 of binder ring 114 and through the trough 130 of upper die 110 around the entire, usually enclosed path, of these linear, ring-like die elements. The shapes of the bead 128 and trough 130 in combination with action of the punch and female die surfaces 116, 118 controls whether an acceptable stamping is formed. It is the control provided by the bead and trough over the flow of blank material that largely determines whether the proper amount of metal is drawn and stretched into the female cavity.

In the example illustrated in FIG. 1, a panel is fully formed from an initially flat blank 114 of sheet metal into the fender member. In a subsequent operation the peripheral portion of the blank that is not used in the forming of the outer fender panel is trimmed away.

Figure 2:
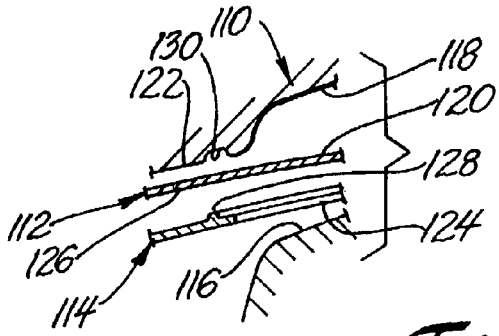
FIG. 2 is an enlarged sectional view of a broken out portion of FIG. 1 showing the male bead on the binder ring and the bead trough on the peripheral surface of the female die with the interposed blank and underlying punch surface.

FIG. 2 is a somewhat enlarged view of a broken out section (at 2—2) of the die components and blank illustrated in FIG. 1. FIG. 2 illustrates one cross-section of a bead 128 and trough 130. As is known to die engineers, the height and width of the bead, or bead segments, and the radii of its corners are specified when the bead is formed on the surface of the binder ring (or on the surface of the upper die if the bead is formed there). Likewise, the corresponding dimensions of a trough, whether formed in the upper die or on the binder ring, are initially specified when the die set is made. However, if the initially specified shapes at mating regions of a bead or trough segment are not suitable they are changed, e.g., reduced or enlarged or provided with sharper or softer radii, during tryout of a die set.

Figure 3:
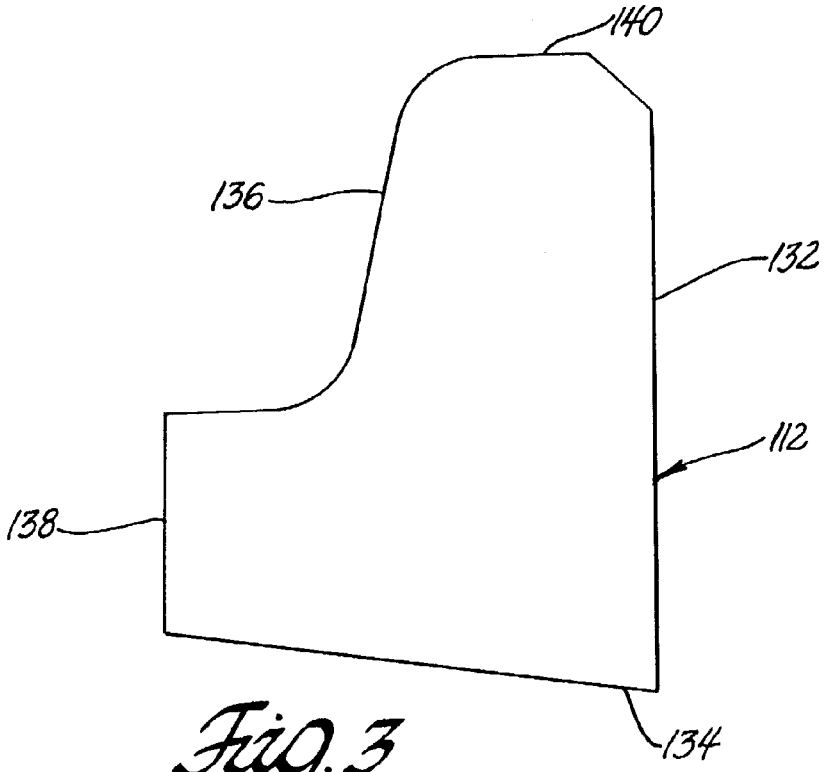
FIG. 3 is a plan view of the precut blank for forming the fender panel.

FIG. 3 is a plan view of the flat, two dimensional outline, of a sheet metal blank 112 for stamping a fender outer panel on the die set surfaces shown in FIGS. 1 and 2. The blank will usually be of a suitable low carbon steel or aluminum alloy composition and have a thickness of, e.g., one to three millimeters. As stated, the mechanical and formability properties of the sheet metal are known and used in the computer aided design of the members of the die set. In this example, the blank is not of simple rectangular shape. The blank is provided with a two-dimensional outline generally resembling the outline of the fender to minimize scrap. But the shape and dimensions of the sides of the blank are important in assuring that the proper amount of metal is available on all sides for draw-in to the forming cavity, e.g., cavity surface 118. And provision must be made in the blank shape for suitable engagement with the binder bead 128 and trough 130 combination. Referring to FIG. 3, edge 140 lies at the front end of what will become the fender panel; 132 at the top of the intended fender; 134 at the rear of the fender next to a door and edges 136 and 138 at the wheel well and bottom, respectively. But the locations of these edges on the blank 112 are located within a millimeter of specified design for use in the draw-in map used in the practice of this invention. Furthermore, the blank 112 is precisely located when it is places in the press between the upper die surface 110 and binder ring 114. For simplicity of illustration, the total perimeter of edges 130–138 is identified as 144 in the draw-in map of FIG. 4.

Figure 4:
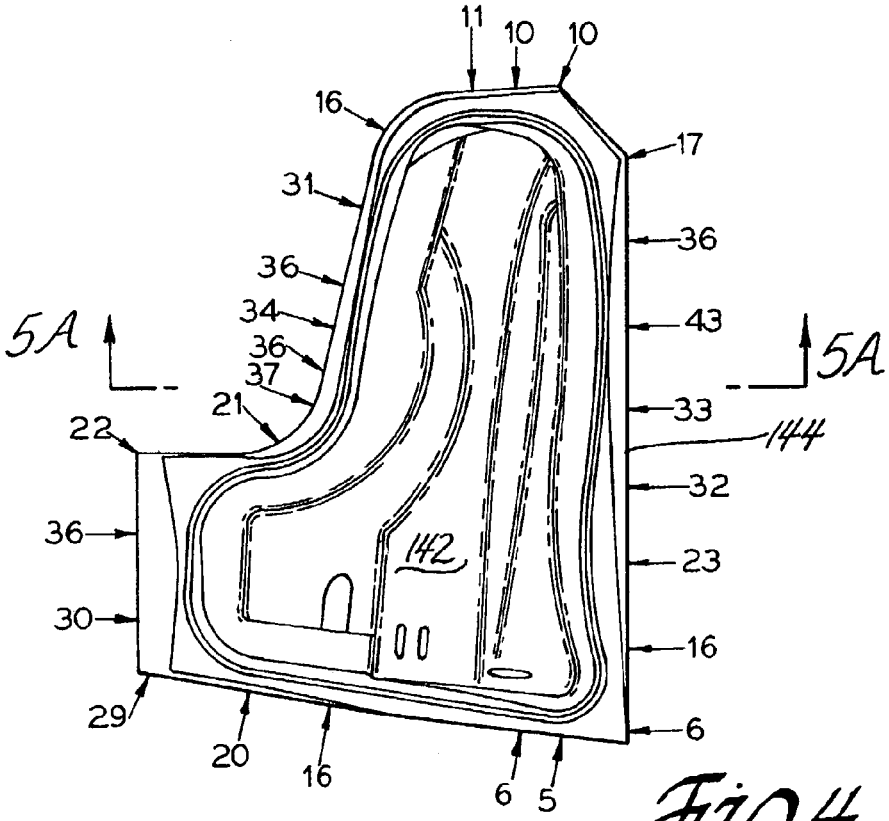
FIG. 4 is a plan view of the formed fender panel including a draw-in map. Drawn around the perimeter of the illustrated, formed sheet meal part is the outline of the original blank. Also marked around the perimeter of the original blank are directional arrows of the sheet metal draw-in and dimensions in millimeters of the amount of metal draw-in for a suitably formed fender panel.

After the upper die surface 110 has completed its full stroke and punch 116 has pushed the blank material into the upper cavity against female cavity surface 118, the press then reverses its motion. The upper die 110 is raised and the stamped part 142 can be removed from the punch surface 116. FIG. 4 is a plan view of the stamped fender panel sheet 142. Fender panel sheet 142 comprises the fender panel shape, corresponding to cavity surface 118, plus peripheral edge material used in the stamping process.

FIG. 4 is an example of an engineered draw-in map essential to the practice of this invention. The outline of the formed sheet metal 142 is shown in plan view FIG. 4. Also superimposed around the perimeter of the deformed sheet metal part is the perimeter 144 of original blank 112. The perimetrical outline of formed part 142 is smaller than the perimetrical outline 144 of blank 112. The sheet material of the formed part 142 has experienced draw-in or displacement from the outline 144 of the original blank 112. The precise amount of draw-in varies around the respective perimeter segments depending upon local flow of the sheet material over the binder ring bead system of bead 128 and trough 130.

Also shown on FIG. 4, are several one and two digit numbers associated with directional arrows. The arrows indicate the direction of draw-in of the stamped sheet metal from the perimeter 144 of the original blank 112. The numbers represent the dimensions, in millimeters, of the draw-in at the location of the associated arrow. The dimensions shown in FIG. 4 are dimensions determined by a math-based simulation of the fender panel sheet metal 142 on a die set corresponding to the try-out die set and under specified engineered tryout conditions for the stamping operation of the type listed in the Summary of Invention section of this specification. Thus, FIG. 4 represents a map of the idealized draw-in of the formed part from the original blank 112 shape in accordance with a math based simulation of the drawing process. Such a map may contain, for example, a draw-in dimension at points every 100 mm or so around the perimeter of the blank and formed piece. While several such draw-in dimensions are shown in FIG. 4 as many as forty or more dimensions might be mapped in a fender panel like that illustrated.

In accordance with this invention, the data in the map of FIG. 4 is used to compare with the actual draw-in dimensions at corresponding locations of a trial stamped part formed during tryout of newly made tooling. The trial stamping is made under the same engineered tryout parameters or conditions as imposed on the math-based simulation. Comparison of a trial part with the engineered draw-in map identifies locations, if any, where there is a significant difference between the experienced draw-in values and math-based simulation draw-in values. It is found that the die tryout process is very effectively shortened by focusing on reducing such differences in draw-in values to match the engineered draw-in. Where the trial part has experienced a significant difference in draw-in compared to the math-based map, the male beads and/or female trough elements are altered to correct the metal flow and the altered die set given a new trial with a new blank. The general relationship between bead and trough size and radii and metal flow is known. The die tryout process is greatly shortened by using a draw-in map as the sole basis of determining alterations to the bead and trough components of a die set.

The use of the math-based draw-in map can be used at intermediate stages of the stroke of the punch member of the die set. In other words, draw-in occurs progressively as the punch progressively forces the blank metal into the cavity of the female die member.

FIGS. 5A–5D illustrate in schematic views how sheet metal draw-in occurs progressively in the forming of the part. These Figures also illustrate a cross-sectional view (at line 5A—5A of FIG. 4) of a bead 128 and trough 130 combination at two locations on the die set diametrically opposed to each other in the sectional view. The bead is illustrated on the binder ring and the trough on the female die surface but these locations can be reversed. Also the press operation is illustrated with the female die being lowered toward the punch but other die set closing modes may be employed.

Figure 5A:
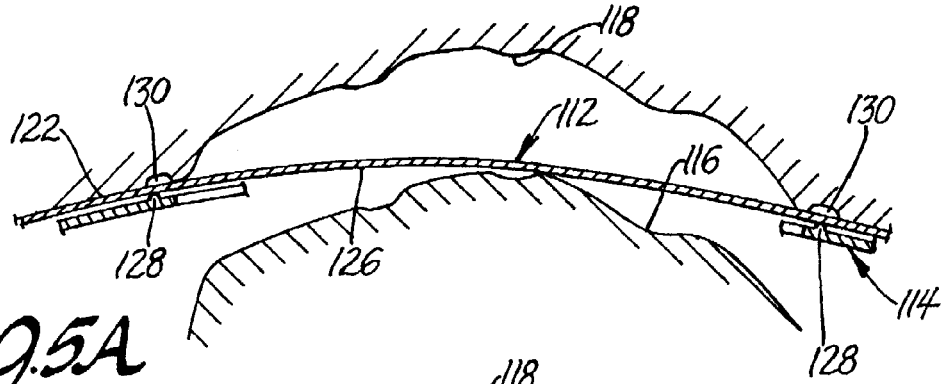
FIGS. 5A–5D are a series of four cross-sectional views (section 5A—5A of FIG. 4) of the position of the punch, binder ring, sheet metal blank and female die surface at progressive stages of the forming operation. In this example the press moves the female die surface downwardly pushing the blank against the binder ring and punch forming surface.

FIG. 5A shows binder ring 114 clamping sheet metal blank 112 against the peripheral surface 122 of the female die surface 118 when the upper die moves. Punch surface 116 just touches the bottom surface 126 of blank 112, but the upper die must still travel a distance of, for example, 137 mm before the die set is fully closed and the stamped metal panel 142 is made. Sheet metal blank 112 is gripped by bead 128 on binder ring 114 and trough 130 on die surface 122 around the perimeter of the sheet. The bead 128 and trough 130 are seen at both sides of the blank 112 in these sectional views of FIGS. 5A–5D. At the position of the punch surface 116 shown in FIG. 5A there has been no draw-in of the blank sheet metal and there is ample blank material (some broken off in 5A) outside of each bead/trough location in this section.

Figure 5B:
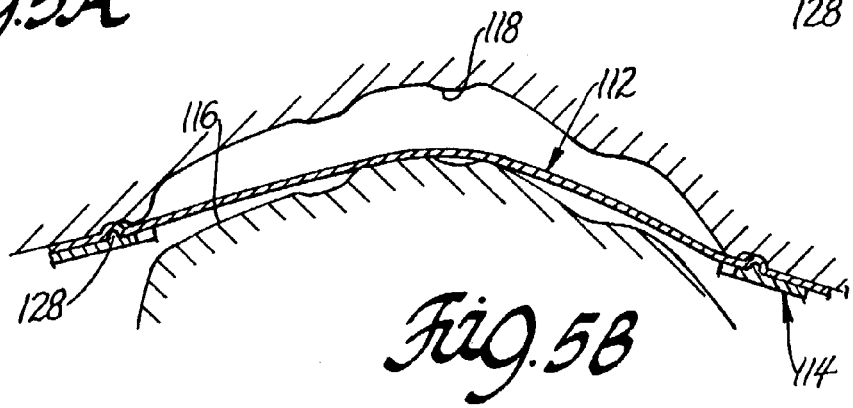

FIG. 5B shows punch surface 116 after the upper die has been moved downwardly over almost half of its forming stroke. For example, it may now be considered to be a distance of 73 mm from the completion of its stroke. Blank 112 is being deformed upwardly toward female die surface 118. Although some metal stretching occurs, this deformation is largely accommodated by blank material being drawn inwardly over bead ring 128 and through trough 130 in the female die peripheral surface 122. The cross-section of the blank 112 illustrated in these FIGS. 5A–5D experiences a significant amount of deformation and provision for adequate draw-in material must be provided. A useful math-based simulation draw-in map could be prepared for this portion of the stroke of the punch surface 116. And a trial part could be prepared by programming the press to stop at this point on its stamping stroke. The draw-in dimensions of the trial part are compared with the math-based draw-in map at this stage of part-making to evaluate die performance at intermediate part formation.

Figure 5C:
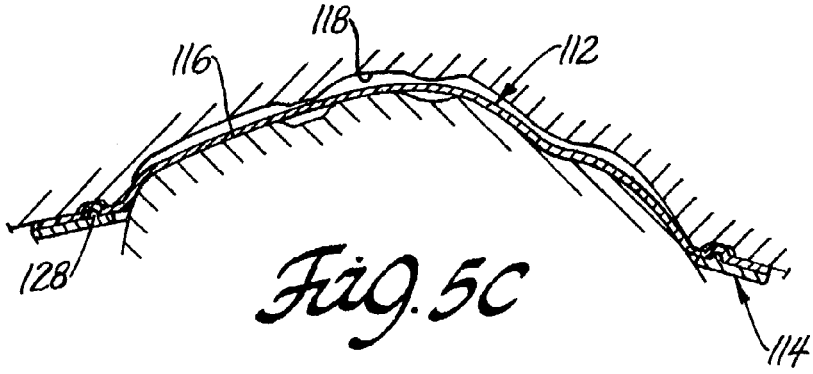

FIG. 5C shows the upper die surface 118 at a further stage of closure. For example, the upper die is now 19 mm from the completion of its forming stroke. More blank material will have been drawn between bead 128 and trough 130. FIG. 5C further illustrates the progressive draw-in of blank metal in the stamping process. As observed with respect to FIG. 5B a math-based draw-in map can be made at any intermediate portion of the punch stroke for assessing suitable metal draw-in at that forming stage during the tryout of a die set.

Figure 5D:
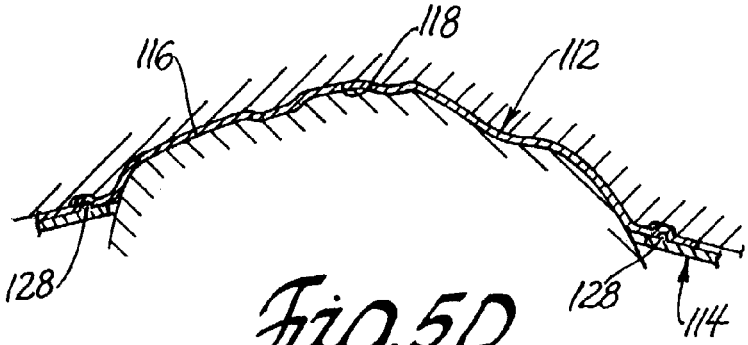

Finally, FIG. 5D shows the punch and punch surface 116 at completion of die set closure with the fender panel now formed. The operation of the die set should be such that peripheral blank material is still within the grip of the binder ring system.

The practice of this invention utilizes math-based simulations to facilitate die tryout. The simulations, made under specified engineered stamping conditions, are used to predict sheet metal blank draw-in during the stamping of a specified sheet metal part. Trial parts are made under the same engineered stamping conditions and the trial part draw-in compared with a map of the math determined draw-in. Comparisons may be made with the fully formed part and at intermediate part forming stages. If the measured draw-in does not match the engineered draw-in, initial trial parts often are unsatisfactory because of defects such as wrinkles or splits or tears in the stamped metal. It is found that a most efficient way to correct such defects is to make use of the draw-in map as a basis for modifications to the binder system. Use of such a map can pin-point locations on the binder ring 128 where metal draw-in does not contribute to a defect free part. Comparison with actual draw-in at a trial part location indicates whether metal flow should be encouraged or restricted. After indicated changes have been made to the binder system a new trial part is made. This try-out approach is repeated to correct metal flow in the die set.

The practice of the invention has been illustrated by illustrative, but not scope limiting examples.

The invention claimed is:

1. A method of adapting a sheet metal forming die set to repetitively make a specified formed sheet metal part having a formed part peripheral edge from a sheet metal blank having a sheet metal blank peripheral edge; said die set comprising a die cavity member with a sheet metal blank binder surface and a binder ring for pressing said blank against said binder surface, said binder surface and binder ring comprising bead and trough surfaces for controlling draw-in of sheet material of said blank into said die cavity during forming of said sheet metal part, said method comprising:

producing a computer simulation of the forming of said part under predetermined engineered forming conditions using a simulation of said die set to obtain a data set of simulated draw-in dimensions of locations on said formed part peripheral edge with respect to corresponding locations on said sheet metal blank peripheral edge;

making a draw-in map of said simulated draw-in dimensions; and comparing said simulated draw-in dimensions of said map with corresponding draw-in dimensions obtained on a trial sheet metal part formed on said sheet metal forming die set for use in adapting said die set for the repetitive stamping of said specified part.

2. A method as recited in claim 1 comprising:

forming a trial part on said sheet metal forming die set under said predetermined engineered forming conditions;

measuring draw-in dimensions of said peripheral edge of said trial part at locations corresponding to draw-in dimensions of said map;

comparing said draw-in dimensions of said map with corresponding draw-in dimensions for said trial sheet metal part;

identifying any location on said peripheral edge of said trial part at which a draw-in dimension differs from said map; and altering said bead and/or trough surfaces to change said draw-in of sheet metal to reduce said difference in draw-in dimension.

3. A method as recited in claim 2 comprising changing the shape of said bead and/or trough surfaces at a location corresponding to said location on said peripheral edge of said trial part to change said draw-in of sheet metal.

4. A method as recited in claim 2 comprising repeating the steps of claim 2 until said die set can repetitively make said specified sheet metal part.

5. A method as recited in claim 3 comprising repeating the steps of claim 3 until said die set can repetitively make said specified sheet metal part.

6. A method of trying out a sheet metal forming die set to adapt it to repetitively make a specified formed sheet metal part having a formed part peripheral edge from a sheet metal blank having a sheet metal blank peripheral edge; said die set comprising a male punch die member, a female die cavity member with a sheet metal blank binder surface, and a binder ring for pressing said blank against said binder surface, said binder surface and binder ring comprising complementary bead ring and trough surfaces for controlling draw-in of sheet material of said blank into said die cavity during a forming movement of said punch, said method comprising:

producing a computer simulation of the forming of said part under predetermined engineered forming conditions using a simulation of said die set to obtain a data set of simulated linear draw-in dimensions at locations around the peripheral edge of said specified formed part with respect to corresponding locations on said sheet metal blank peripheral edge;

making a draw-in map of said simulated linear draw-in dimensions;

forming a trial part on said sheet metal forming die set under said predetermined engineered forming conditions;

measuring draw-in dimensions for the peripheral edge of said trial part at locations corresponding to draw-in dimensions of said map;

comparing said draw-in dimensions of said map with corresponding draw-in dimensions for said trial sheet metal part;

identifying any location on the peripheral edge of said trial part at which a draw-in dimension differs from said map; and altering said bead ring and/or trough surfaces to change said draw-in of sheet metal to reduce said difference in draw-in dimension.

7. A method as recited in claim 6 comprising altering said bead ring and/or trough surfaces at a location corresponding to said location on said peripheral edge of said trial part.

8. A method as recited in claim 6 in which said forming movement of said punch comprises a movement from a point of first engagement of said sheet metal blank to a final forming point in which said blank has been pushed into conformance with said die cavity member, said method comprising:

producing said computer simulation of the forming of said part when said punch is at said final forming point, and forming said trial part to said final forming point.

9. A method as recited in claim 6 in which said forming movement of said punch comprises a movement from a point of first engagement of said sheet metal blank to a final forming point in which said blank has been pushed into conformance with said die cavity member, said method comprising:

producing said computer simulation of the forming of said part when said punch is at an intermediate forming point between said point of first engagement and said final forming point, and forming said trial part to said intermediate forming point.

10. A method as recited in claim 6 comprising repeating said forming, measuring, comparing, identifying and altering steps until said die set can repetitively make said specified sheet metal part.

11. A method as recited in claim 7 comprising repeating said forming, measuring, comparing, identifying and altering steps until said die set can repetitively make said specified sheet metal part.

12. A method as recited in claim 8 comprising repeating said forming, measuring, comparing, identifying and altering steps until said die set can repetitively make said specified sheet metal part.

* * * * *